United States Patent [19]

Wade et al.

[11] 4,058,042

[45] Nov. 15, 1977

[54] KEY TRANSPOSING ELECTRONIC ORGAN

[75] Inventors: David R. Wade, Norwood, Ohio; Walter Munch, Jr., Fort Thomas, Ky.

[73] Assignee: D. H. Baldwin Company, Cincinnati, Ohio

[21] Appl. No.: 588,625

[22] Filed: June 20, 1975

[51] Int. Cl.[2] ..... G01H 1/02; G10C 3/12

[52] U.S. Cl. ..... 84/1.01; 84/1.04; 84/445

[58] Field of Search ..... 84/1.01, 1.14, 445

[56] References Cited

U.S. PATENT DOCUMENTS

| | | | |
|---|---|---|---|
| 3,610,800 | 10/1969 | Deutsch | 84/1.01 |
| 3,800,060 | 3/1974 | Hallman, Jr. | 84/1.01 |
| 3,824,325 | 7/1974 | Obayashi et al. | 84/1.01 |
| 3,877,337 | 4/1974 | Obayashi | 84/1.01 |

*Primary Examiner*—E. S. Jackmon

*Attorney, Agent, or Firm*—Melville, Strasser, Foster & Hoffman

[57] ABSTRACT

A transposing electronic instrument wherein the clock frequency applied to control a top octave frequency generator is derived by comparing any single output of the generator with the response of a frequency reference circuit to that output, deriving a dc voltage representative of the difference in frequency of the input and output of the reference circuit and controlling the clock frequency from the dc voltage, thereby transposing all the outputs of the top octave frequency generator.

7 Claims, 2 Drawing Figures

KEY TRANSPOSING ELECTRONIC ORGAN

BACKGROUND OF THE INVENTION

In a keyed instrument, such as an electronic organ, certain music can be played by manipulating only the white keys, while other musical selections require manipulating the white and the black keys. Playing a selection in certain keys, for example C major, may require playing only the white keys. Playing that same selection in the key of D, requires the playing of both black and white keys. Accordingly, transposing from one musical key to another is difficult for the unskilled musician.

Many devices have been developed for transposing the key of an electronic instrument. These are simple in concept, but expensive and involved in implementation. For example, transpose switches may transpose tone signal outputs in respect to key switches, or all of the separate tone signal sources may be re-tuned to produce the required transposed tones, i.e., the C oscillator may be uptuned to C♯, etc.

In U.S. Pat. No. 3,824,325 to Obayashi et al, issued July 16, 1974, a transposition system is disclosed which employs a pair of octave generators, a fixed frequency master oscillator, and a simple transpose switch. However, this system, because it employs cascade frequency division in its octave generators, is relatively inaccurate in its tone frequencies. A more accurate type of top octave frequency divider can be employed, but this requires a master oscillator in the megacycle range, and the philosophy of the patent then becomes inapplicable.

A transposer employing a fixed frequency oscillator and a voltage controlled oscillator in a phase locked loop, the VCO supplying clock pulses directly to an octave generator and the output of any selected divider of the octave generator being compared with a frequency derived by division with a fixed ratio from a crystal controlled oscillator, is disclosed at Page 14 of an article published by General Electric Company, on Nov. 30, 1970, the author being Gerald L. Kmetz. A similar system is patented in U.S. Pat. No. 3,800,060 to Hallman, issued Mar. 26, 1974.

In accordance with the present invention, the divider output of an octave generator, selected by a manual switch according to the transposition desired, is compared with a reference filter which introduces a phase shift as a function of frequency. Comparison of the phase of the output of the filter with its input in an integrator produces a voltage which controls the output of a VCO, which supplies clock pulses to the octave generator. No clock pulse source other than the VCO is required, contrary to the above described prior art system. (Kmetz)

The present invention has for its objective the provision of a transposer which employs a single octave generator, of the type which requires a single high frequency voltage controlled clock, and no additional oscillator.

SUMMARY OF THE INVENTION

A key transposer for an electronic organ, requiring only a single top octave frequency generator, the latter requiring one high frequency clock, and which operates by changing the frequency of the clock as a function of one output signal frequency derived from the generator.

DETAILED DESCRIPTION

Figure 1:
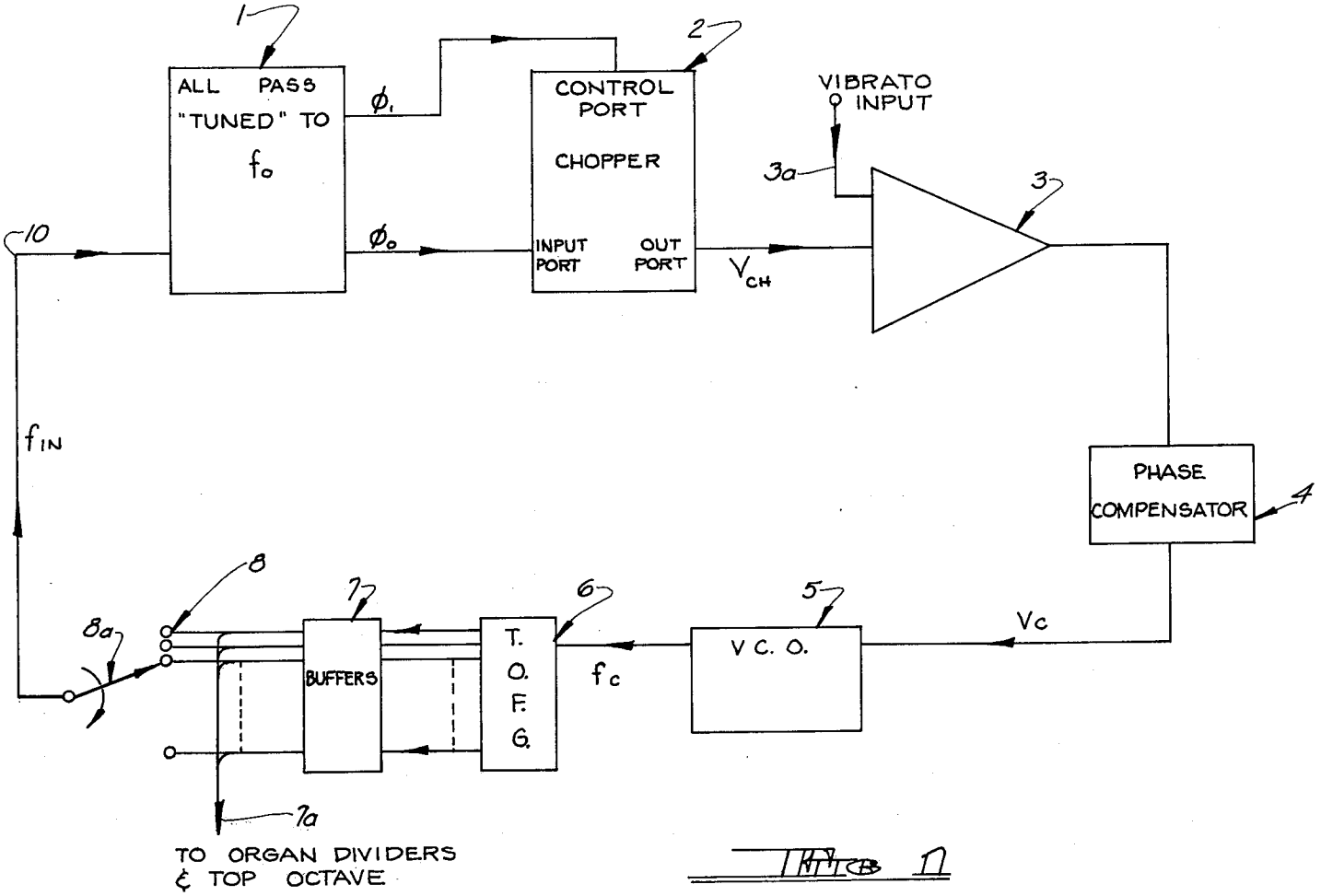
FIG. 1 is a block diagram of a system according to the invention.

Referring now to FIG. 1 of the accompanying drawings, 1 is an all pass filter producing a 90° phase shift between its outputs at the frequency fo. An all pass filter may be defined as a filter which passes a range of frequencies with a substantial phase shift which is proportional to frequency. The output of the filter, $\phi o$, is applied to an input port of a chopper 2. The phase shifted version of $\phi o$, i.e., $\phi_1$ is applied to the control port of the chopper 2. The output port of the chopper is then a chopped pulse $V_{CH}$, the the average value of which is a function of the phase difference between $\phi o$ and $\phi_1$.

The output of the chopper, $V_{CH}$, is applied to a high gain dc amplifier, 3, designed to integrate $V_{CH}$. The transient output of amplifier 3 is phase compensated as a function of frequency, in a phase shifter 4, to avoid oscillations, and the output of phase shifter 4 is a dc voltage $V_C$.

A vibrato input voltage is provided on lead 3*a*, so that the output of integrator 3 varies in amplitude at about 6.Hz. The voltage $V_c$, modulated in amplitude at about 6.Hz, is applied to a voltage controlled oscillator (VCO) 5, the output of which is $f_C = K V_C + B$. Here K is a proportionately constant, and B a fixed frequency which appears even if $V_c$ is zero.

The frequency $F_c$ is applied as a clock frequency to an octave generator 6, which generates the tone signals of the top octave of an electronic organ, from which all tone signals of the organ may be derived by successive divisions by 2. The generator 6 is usually called a top octave frequency generator (TOFG).

The outputs of TOFG 6 are buffered by amplifiers 7, and the buffered outputs applied by twelve leads 7*a* to the organ dividers, but are also applied to stationary switch points 8. Any one of the switch points 8 may be connected via a movable switch arm 8*a* to the input of the all pass filter 1. The all pass filter is tuned to a set frequency of F♯5 at 5919.8 Hz. The control loop then maintains the frequency of VCO[5] at such a value as will maintain the output at switch arm 8*a*, i.e., $F_{IN}$, at frequency $f_o$ regardless of the position of switch arm 8*a*.

Figure 2:
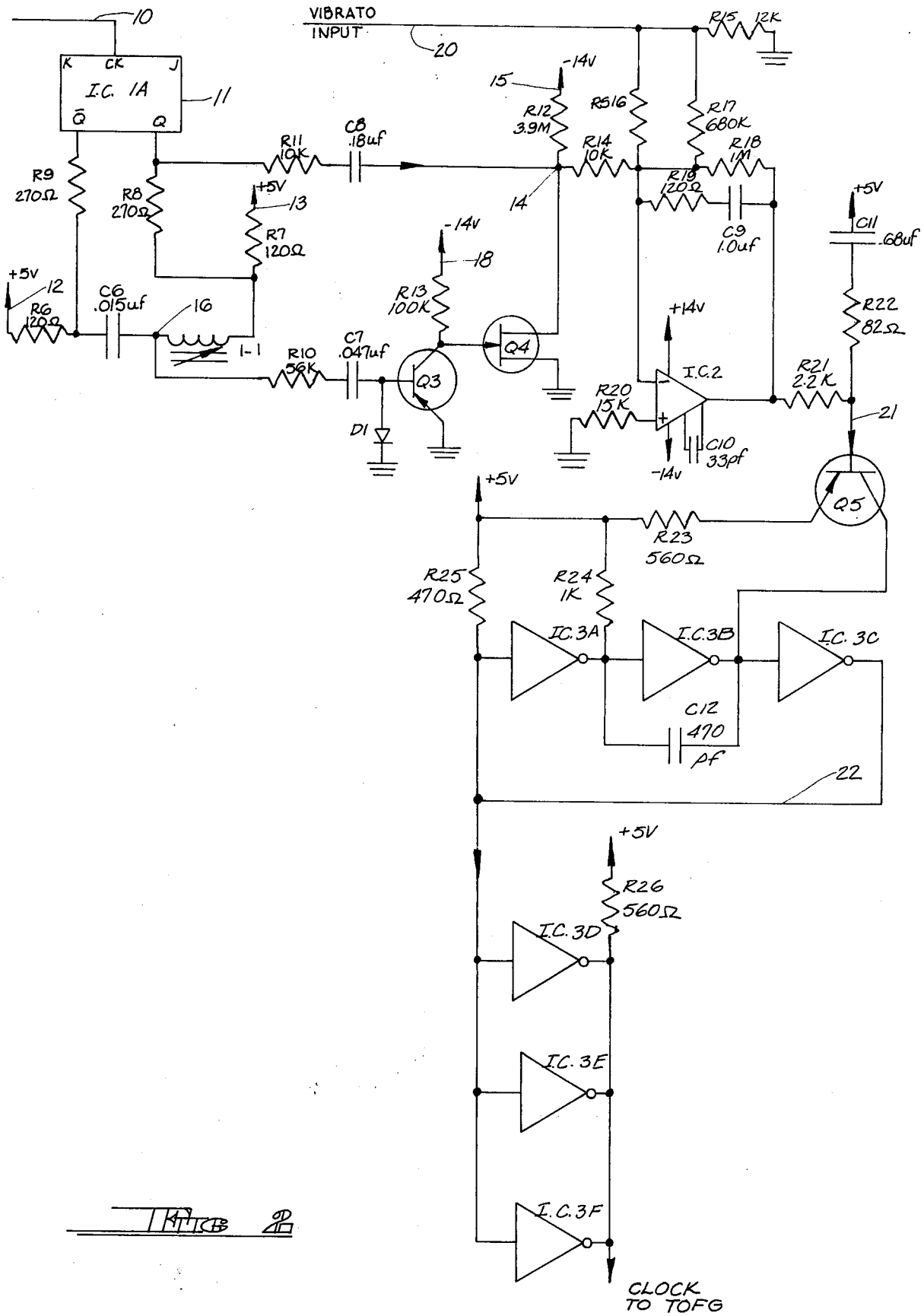
FIG. 2 is a schematic circuit diagram of portions of the system of FIG. 1.

In FIG. 2 of the accompanying drawings, 2fin is applied to lead 10. Block 11 represents a JK flip-flop having outputs Q and $\overline{Q}$, at a frequency fin/2. Power is supplied to the flip-flop 11 from terminals 12 and 13 and the outputs Q and $\overline{Q}$ are applied across a series resonant circuit composed of C6 and L1, tuned to 2460.0 Hz. The output Q is applied via resistance R11 and capacitance $C^8$ to point 14. To point 14 is applied voltage from terminal 15 through a large resistance $R^{12}$ (3.9M). Current flowing into point 14 is applied to the source of FET Q4, the drain electrode of which is grounded. The midpoint 16 of $C_6$ and $L_1$ is applied via capacitor $C_7$ to the base of a PNP transistor $Q_3$, having its emitter grounded and its collector connected to a negative source 18 via a load resistance R13. The base of $Q_3$ is clamped to ground for positive voltage by diode D1 and its collector is directly connected to the control electrode of FET $Q_4$. Positive going pulses thus appear at the base of $Q_3$ and cut off $Q_3$, which in turn supplies cut-off pulses to $Q_4$.

Pulses then appear at the negative input terminal of op amp I.C.2. Superimposed on these pulses is a vibrato signal derived from lead 20. I.C.2 has a feedback circuit including capacitor C9 and resistance R19 in series, so that integration occurs. I.C.2 corresponds with high gain dc amplifier 3 of FIG. 1. Resistance R22, R21 and capacitor C11 correspond with phasing circuit 4 of FIG. 1. The signal in lead 21 is then Vc of FIG. 1. VCO5 of FIG. 1 includes three open collector inverters such as found in Texas Instruments SN7405, I.C. 3A, 3B and 3C, all in series. Inverter I.C. 3B has capacitive feedback supplied by capacitor C12 and also has resistive feedback provided by R23, R24 and the emitter-collector circuit of transistor Q5. Overall feedback from the output of I.C. 3C to the input of I.C. 3A is supplied over lead 22. Variation of the base voltage of Q5 then varies the charging currents of C12 and varies the frequency of the oscillator 5.

The output of V.C.O.5 is buffered by parallel inverters I.C. 3D, 3E and 3F, and the outputs of these are applied as clock frequency to TOFG 6.

The emitter of Q5 is referenced to near 5.V. One plate of C11 is therefore also referenced to 5.V to avoid transients on the 5 volts from affecting the current in Q5. The phase compensator elements C11, R22, assures that the total phase shift around the control loop will not introduce self-oscillations.

An important feature of the system is a frequency detector network and chopper, blocks 1 and 2 of which constitute a frequency discriminator tuned to the frequency *fo* by C6 and L1, and which generates a signal whose DC component is a function of the difference between $f_{IN}$ and $f_o$. This error signal, $V_{CH}$, is further processed by high gain Lo-Pass amplifier, block 3, to extract the before-mentioned DC error signal, and amplify it greatly. To insure circuit stability an RC phase compensating network, block 4, is used at this point. The output of this network, $V_c$, is used as the control voltage for the Voltage Controlled Oscillator, 5, which generates a high frequency clock signal, which the TOFG chip, 6, uses to synthesize 13 top octave frequencies for the instrument.

The TOFG 6 is typical of devices used in the industry to generate 13 top octave audio tones from one high frequency (typically approx. 2MHZ) clock. There is a constant ratio between any one of the 13 outputs and the input clock such that $f$ input clock/$N_i = f$ output. It is one of these 13 signals which is selected by the transposer switch, 8*a*, after being buffered by buffer amplifiers, 7, that is compared to the frequency $f_o$ in the frequency comparator, 1, mentioned previously.

The phasing and operation of the described loop is such that the output of the VCO, 5, labeled $f_c$ is forced by the loop to a frequency where the output selected by the transpose switch, 8, 8*a* of the TOFG 6 will be the same frequency as the standard frequency $f_o$ in the frequency detector network, 1. Thus, by feeding back a semitone related output of the TOFG 6, via the transpose switch, 8, 8*a*, the entire 13 outputs of the TOFG, 6, will be forced to shift by a whole semitone amount in the appropriate direction. By extending this procedure an entire octave of transposition results for the instrument. For a given point of operation $f_{IN}$ is related to $f_c$ by $f_c/N_i = f_{IN}$ (where $N_i$ are the divider ratios in the TOFG 6). Changing the transpose switch, 8, 8*a*, effectively alters $N_i$. Thus the new point of operation is determined solely by the ratio of $N_1/N_2$ where $N_1$ was the previous output ratio selected and $N_2$ the new output selected. This illustrates that the shift in operating frequency and thus the amount the instrument is transposed is determined chiefly by the frequency divider ratios, $N_i$, inherent in the TOFG, 6.

In the preferred embodiment, the frequency detector and chopper consists of Q3, and Q4 and ICIA. ICIA is a divide-by-two flip-flop whose two out-of-phase outputs Q and Q drive an all-pass network composed of L1, C6, and R6-9. The reference frequency, $f_o$ in this case becomes $$\frac{1}{2\pi\sqrt{L1C6}}.$$

Using IC1's Q output as the 0° phase component, the signal at the junction of C6 and L1 will vary in phase such that:

if Ti $f_{IN} = f_o, \Delta\phi = 90°$ Ti $f_{IN} << f_o, \Delta\phi \rightarrow 0°$ Ti $f_{IN} >> f_o, \Delta\phi \rightarrow 180°$ Thus, by using this signal to chop (by the action of Q3 and Q4) the unshifted phase component at the output Q of IC1A, an error voltage, whose DC component is a function of the difference between $F_{IN}$ and $f_o$ is generated. This DC component is extracted and amplified by IC2 and associated components. The phase compensating network consists of R21, R22, and C11. This network is followed by a V.C.O. composed of Q5 and IC3A, IC3B and IC3C and associated components, output of which is buffered and level shifted by IC3D, IC3E and IC3F to drive TOFG 6. The outputs of TOFG 6 are buffered by transistor amplifiers and associated components. The buffer outputs provide the instrument's top octave of signal and feed the transposer switch, thus completing the loop.

Vibrato modulation is achieved by introducing vibrato voltage at an input of IC2, which modulates the error signal in amplitude.

What we claim is:

1. A method of transposing, comprising generating a plurality of note signals by frequency division, comparing the phase of any note signal with the phase of the same note signal as processed by an all pass network tuned to a reference frequency, generating a dc control signal as a function of the comparison, generating a clock frequency in response to said dc control signal and using said clock frequency for said frequency division.

2. The method according to claim 1 wherein is further provided the step of amplitude modulating said dc control signal at vibrato frequency.

3. A system for transposing electronic organ music comprising a top octave frequency generating means means for selecting any one output frequency of said top octave frequency generator, a phase comparator including an all pass filter network and means for comparing the phase of an input to an output from said all pass filter network, an integrator responsive to the output of said phase comparator, a voltage controlled oscillator responsive to the output of said integrator, and means connecting the output of said voltage controlled oscillator to the input of of said top octave frequency generator.

4. A system for transposing electronic music, comprising an oscillator, an octave generator responsive to said oscillator and comprising means for deriving by frequency division an octave of semi-tone frequencies, switch means for selecting any one of said semi-tone frequencies, a frequency discriminator responsive to said selected semi-tone frequency and tuned to a fixed, non-generated reference frequency, and means connecting the output of said frequency discriminator to said oscillator to form a control loop whereby said frequency discriminator provides an output signal for varying the frequency of said oscillator match said selected semi-tone frequency to said reference frequency.

5. The combination according to claim 4, wherein is provided means for varying said output signal at a vibrato rate, whereby said oscillator is modulated in frequency at said vibrato rate.

6. The combination according to claim 4, wherein said frequency discriminator includes means for generating a pair of pulse trains of variable phase difference and a chopper for chopping one of said pulse trains in response to the other, and wherein means are included for integrating the output of said chopper to generate a control voltage, said oscillator being a voltage controlled oscillator responsive to said control voltage.

7. The combination according to claim 6, wherein is provided means for varying the amplitude of the output of said integrator at a vibrato rate.

* * * * *